US007523854B2

(12) United States Patent
Gray

(10) Patent No.: US 7,523,854 B2
(45) Date of Patent: Apr. 28, 2009

(54) DRAIN PAN ASSEMBLY

(75) Inventor: William R. Gray, P.O. Box 1326, Coats, NC (US) 27521-1326

(73) Assignee: William R. Gray, Coats, NC (US)

( * ) Notice: Subject to any disclaimer, the term of this patent is extended or adjusted under 35 U.S.C. 154(b) by 0 days.

(21) Appl. No.: 11/696,628

(22) Filed: Apr. 4, 2007

(65) Prior Publication Data

US 2008/0245802 A1 Oct. 9, 2008

(51) Int. Cl.
*B65D 1/34* (2006.01)
*B65D 1/42* (2006.01)

(52) U.S. Cl. ..... 229/114; 220/571; 220/657; 229/119; 229/186

(58) Field of Classification Search ..... 229/114, 229/119, 186, 165; 220/571, 573, 656, 657, 220/658
See application file for complete search history.

(56) References Cited

U.S. PATENT DOCUMENTS 671,155 A * 4/1901 Avery ..... 220/658
3,155,304 A * 11/1964 Beerend ..... 229/186
3,403,837 A * 10/1968 Farquhar ..... 229/114
3,559,869 A * 2/1971 Reynolds ..... 229/119
3,640,209 A * 2/1972 Wilson ..... 220/573.1
3,669,340 A * 6/1972 Kinney ..... 229/186
4,049,150 A * 9/1977 Goettl ..... 229/186
4,201,307 A * 5/1980 Malloy ..... 220/573
4,260,098 A * 4/1981 Manizza et al. ..... 229/186
5,638,978 A * 6/1997 Cadiente ..... 229/186
5,716,840 A * 2/1998 Kahler et al. ..... 220/573
6,135,133 A * 10/2000 Ridgeway, Jr. ..... 220/571
6,718,788 B1 * 4/2004 Shuck ..... 220/571
2003/0222087 A1 * 12/2003 Frickel ..... 220/571

* cited by examiner

*Primary Examiner*—Gary E Elkins
(74) *Attorney, Agent, or Firm*—Brian B. Shaw, Esq.; Stephen B. Salai, Esq.; Harter Secrest & Emery LLP

(57) ABSTRACT

A drain pan assembly for receiving liquids from air conditioners, refrigerators, and freezers comprising a blank having peripheral edges, base forming fold lines, and corner piece forming fold lines, wherein at least two corner piece forming fold lines and a portion of the peripheral edges, form each corner piece. The corner piece further comprises a diagonal corner fold line. Folding each corner piece along each diagonal corner fold line forms corner flaps. Each corner flap is bent about each of the corner piece forming fold lines to dispose the corner piece forming fold lines adjacent to each other and the diagonal corner fold lines adjacent to a surface of each peripheral wall.

12 Claims, 5 Drawing Sheets

DRAIN PAN ASSEMBLY

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A "SEQUENCE LISTING"

Not applicable.

BACKGROUND OF THE INVENTION

1. Field of the Invention

The present invention relates to drain pans for receiving and retaining liquids from air conditioners, refrigerators, freezers and the like and more particularly to stackable drain pans having peripheral tapered walls.

2. Description of Related Art

There are many types of containers for collecting liquids from appliances such as air conditioners, refrigerators, and freezers. Typically, the containers are made of a malleable material and are shaped and sized to fit these particular appliances. The drain pans for air conditioners, refrigerators and freezers are usually square or rectangularly shaped to accommodate each appliance shape.

A problem with square or rectangular shaped drain pans is that the corners often leak around the seams. Further, the shipping and handling costs of a package having multiple drain pans are significant since the drain pans typically have perpendicular walls and therefore, are not nestable. Storing multiple drain pans is also expensive and cumbersome as it requires large amounts of space.

Additionally, square or rectangular shaped drain pans made of metal often have sharp peripheral wall edges and/or corners. Therefore, it is easy for one to cut their hands when handling the drain pan.

Therefore, the need exists for a drain pan that is seamless so as to reduce leakage. Further, a drain pan that is inexpensive to ship and store is needed. Thus, a need exists for drain pans that can stack one atop the other, wherein the peripheral tapered walls of a first drain pan are substantially contained within the peripheral tapered walls of a second drain pan such that the first drain pan nests within the second drain pan. This nesting provides a less voluminous stack of drain pans for shipping and storing. Additionally, the need exists or a drain pan with hemmed edges to reduce exposed single thickness edges which can injure a user when handling the drain pan.

BRIEF SUMMARY OF THE INVENTION

The present invention provides a stackable drain pan for air conditioners refrigerators, freezers, and the like in one configuration, the drain pan comprises a base, at least four peripheral walls that are tapered and four corners, each corner includes a corner flap folded so that the flap overlies an adjacent surface of a peripheral tapered wall. The peripheral edge of each wall further comprises a hem forming a rounded exposed edge. A plurality of drain pans can be stacked) wherein a substantial substantial portion of the peripheral tapered walls of a second drain pan.

The drain pan can be constructed from a blank by folding the blank along base forming fold lines to form peripheral tapered walls, folding each of the corner pieces along a diagonal corner fold line to form a corner flap, and bending each corner flap along at least two corner piece forming fold lines so that each corner flap overlies an adjacent peripheral tapered wail to form a sealed corner.

DETAILED DESCRIPTION OF THE INVENTION

Figure 1:
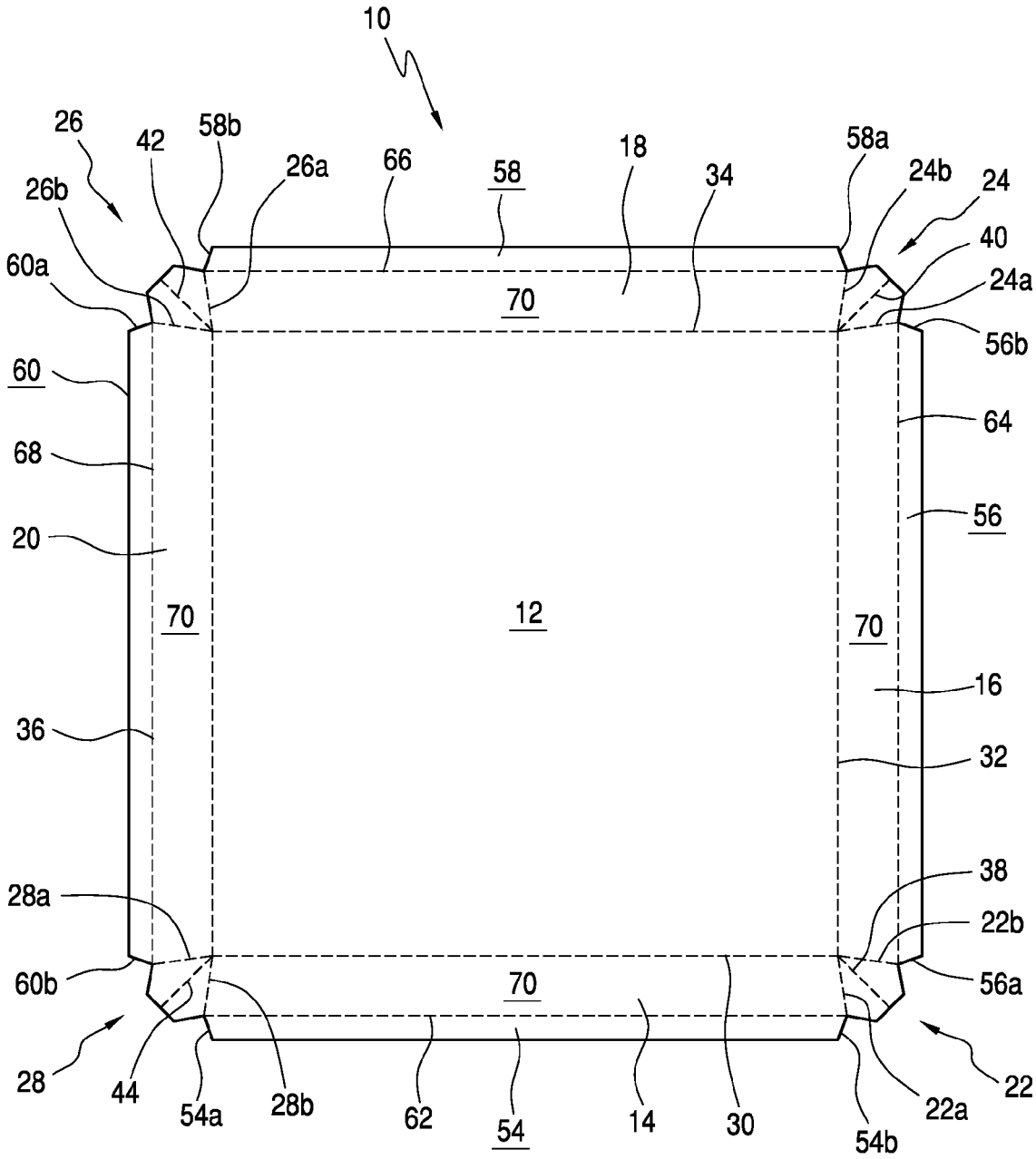
FIG. 1 is a top plan view of a blank of the present invention.
Figure 2:
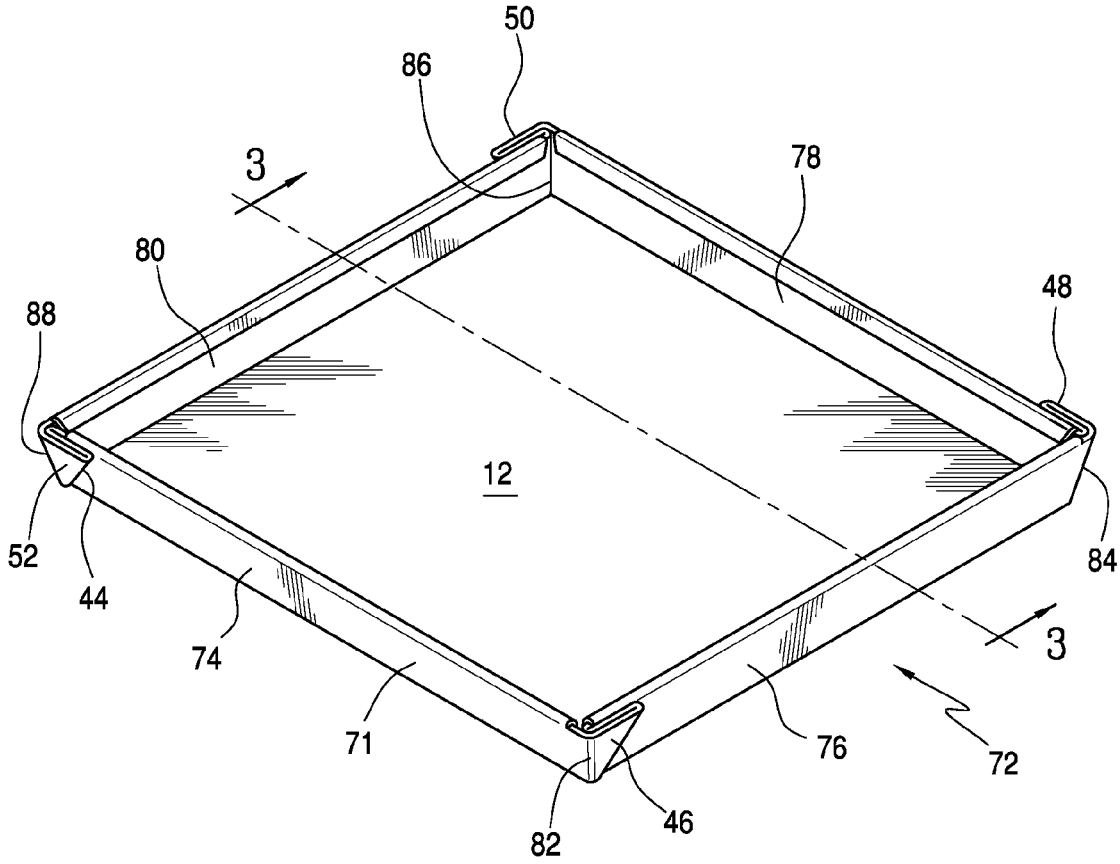
FIG. 2 is a perspective view of the present invention showing the blank folded to define a container.

Referring to the figures, FIG. 1 is a top plan view of blank 10 of the present invention. Blank 10 broadly comprises base 12, peripheral sections 14, 16, 18, 20, corner pieces 22, 24, 26, 28, base forming fold lines 30, 32, 34, 36, and corner piece forming fold lines 22*a*, 22*b*, 24*a*, 24*b*, 26*a*, 26*b*, 28*a*, 28*b*. Each corner piece 22, 24, 26, 28 is defined by two corner piece forming fold lines 22*a* and 22*b*, 24*a* and 24*b*, 26*a* and 26*b*, 28*a* and 28*b*, respectively, which are disposed at acute angles. Corner pieces 22, 24, 26, 28 further comprise diagonal corner fold lines 38, 40, 42, 44, respectively. By "acute angles" it is meant that each corner piece forming fold line 22*a*, 22*b*, 24*a*, 24*b*, 26*a*, 26*b*, 28*a*, 28*b* is less than 45 degrees from diagonal corner folding lines 38, 40, 42, 44, respectively. The portions of the peripheral sections 14, 16, 18, 20 forming corner pieces 22, 24, 26, 28 are notched, thereby reducing the edge size as described infra. When corner pieces 22, 24, 26, 28 are folded along the diagonal corner fold lines 38, 40, 42, 44, respectively, corner flaps 46, 48, 50, 52, as shown in FIG. 2, are formed. Peripheral sections 14, 16, 18, 20 further comprise hems 54, 56, 58, 60, which when folded along respective hem fold lines 62, 64, 66, 68 overlie the interior surface 70 of peripheral sections 14, 16, 18, 20.

FIG. 2 is a perspective view of the present invention showing blank 10 folded to define container 72. Container 72 comprises base 12, four peripheral tapered inclined walls 74, 76, 78, 80, and corners 82, 84, 86, 88. Corners 82, 84, 86, 88 are operatively arranged to be seamless to reduce the ability of a liquid such as oil, water and the like from leaking. Each corner flap 46, 48, 50, 52 is bent about the corresponding corner piece forming fold lines 22*a*, 22*b*, 24*a*, 24*b*, 26*a*, 26*b*, 28*a*, 28*b*, respectively, as shown in FIG. 1, described in more detail infra. Thus, for example the end of peripheral tapered wail 74 is adjacent to the end of peripheral tapered wail 80. In 44 (diagonal corner fold lines 38, 40, 42 are shown in FIG. 1) are disposed adjacent to and overlie exterior surface 71 of peripheral tapered walls 74, 76, 78, 80 respectively. While corner flaps 46, 48, 50, 52 are shown overlying exterior surface 71 of peripheral tapered wails 74, 76, 78, 80, it should be appreciated that corner flaps 46, 48, 50, 52 can instead overlie interior surface 70 of peripheral tapered walls 74, 76, 78, 80 container 72 to receive additional, substantially identical containers therein. By "tapered outwardly" it is meant that walls 74, 76, 78, 80 are inclined at obtuse angles. That is, walls 74, 76, 78, 80 are inclined at angles greater than 90 degrees and less than 180 degrees and thus taper from the hem to the respective base forming fold line. It should be appreciated that hems 54, 56, 58, 60 have notched terminal ends 54*a* and 54*b*, 56*a* and 56*b*, 58*a* and 58*b*, and 60*a* and 60*b* (as shown in FIG. 1), to accommodate the angle of walls 74, 76, 78, 80.

Figure 3:
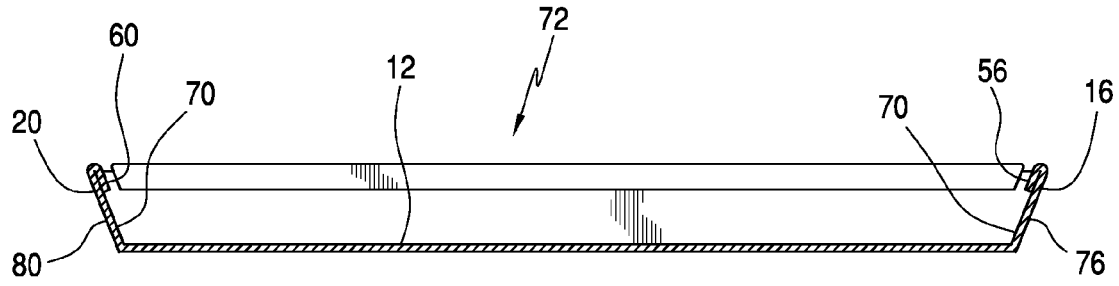
FIG. 3 is a cross-sectional view of the present invention taken generally along lines 3-3 in FIG. 2.

FIG. 3 is a cross-sectional view of the present invention taken generally along lines 3-3 in FIG. 2. In this view, hems 56 and 60 are shown folded along respective hem fold lines 64 and 68 (shown in FIG. 1) such that hems 56, 60 overlie the interior surface 70 of peripheral sections 16, 20. Each hem 54, 56, 58, 60 (hems 54, 60 shown in FIG. 1) therefore, comprises at least two layers of material. It should be appreciated that since peripheral sections 14, 16, 18, 20 have hems 54, 56, 58, 60, it is less likely that one can cut themselves. Preferably, container 72 is made of galvanized metal. A satisfactory range of thickness of the galvanized metal has been found to be between approximately 0.016 inches and 0.026 inches.

Figure 4:
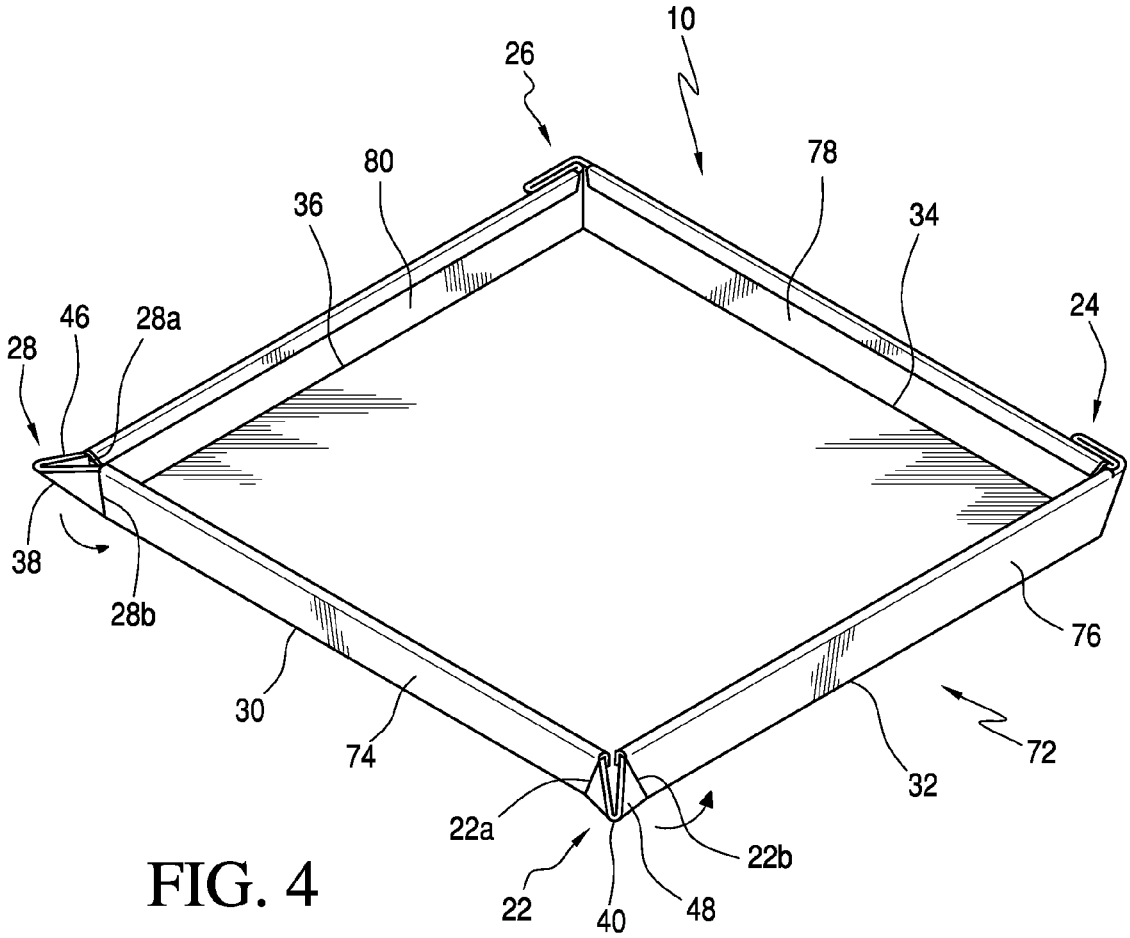
FIG. 4 is a perspective view of the present invention showing corner flaps being folded towards an exterior surface of a peripheral sidewall.
Figure 5:
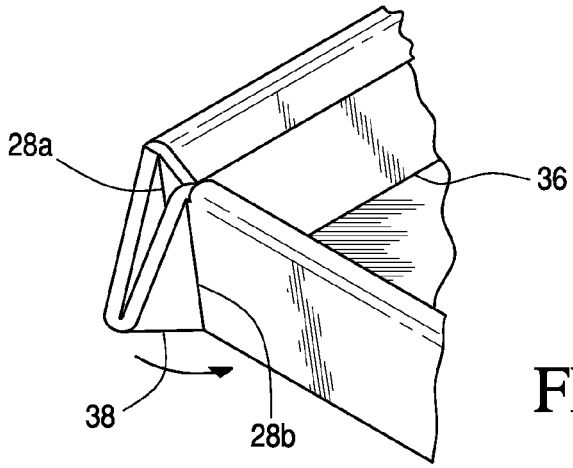
FIG. 5 is a perspective view of the present invention showing corner flaps continuing to be folded towards the exterior surface of the peripheral sidewall.
Figure 6:
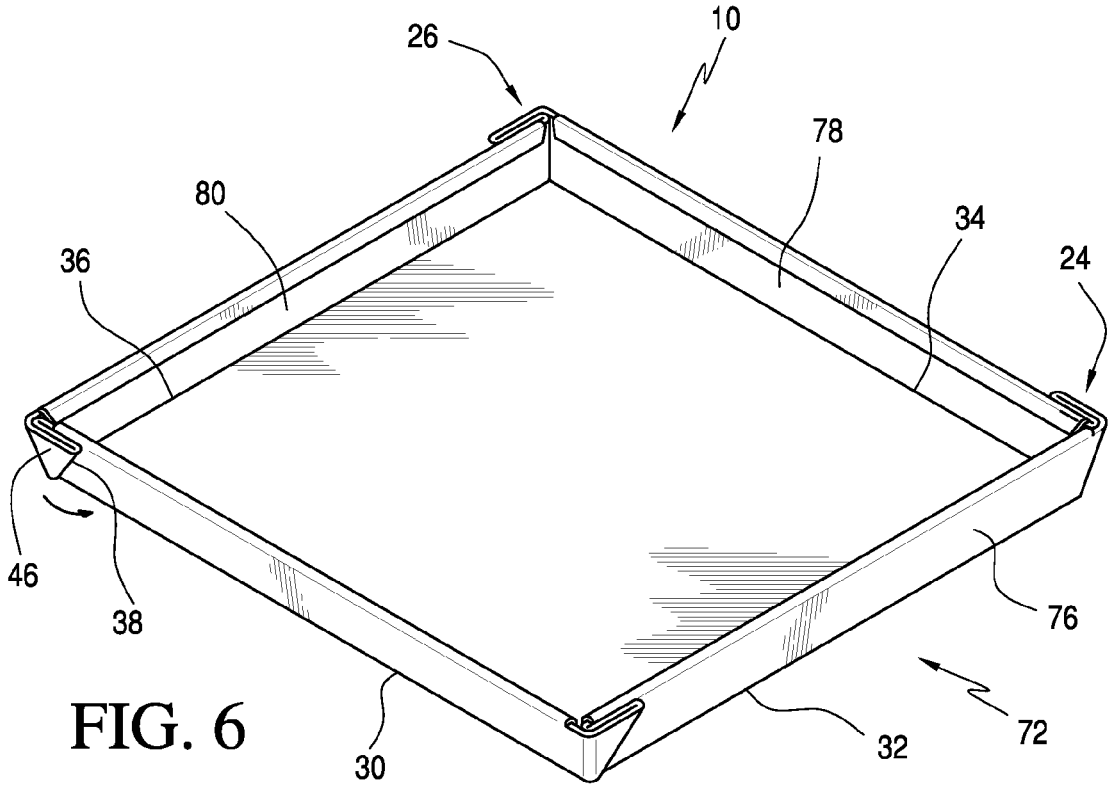
FIG. 6 is a perspective view of the present invention showing corner flaps folded to form a seamless corner.

FIGS. 4-6 illustrate a folding sequence for forming container 72. Blank 10 (shown in FIG. 1) is folded along base forming fold lines 30, 32, 34, 36 to form peripheral tapered walls 74, 76, 78, 80. Each corner piece 22, 24, 26, 28 is then folded along diagonal corner fold line 38, 40, 42, 44, respectively, to form corner flaps 46, 48, 50, 52. Finally, corner flaps 46, 48, 50, 52 are each folded in a first direction around corner piece forming fold lines 22*a*, 22*b*, 24*a*, 24*b*, 26*a*, 26*b*, 28*a*, 28*b* such that each set of corner piece forming fold lines 22*a* and 22*b*, 24*a* and 24*b*, 26*a* and 26*b*, and 28*a* and 28*b* are adjacent to each other. By "first direction" it is meant that corner flaps 46, 48, 50, 52 are folded in a counter-clockwise direction. However, it should be appreciated by one having ordinary skill in the art that some or all of the corner flaps may be folded in other directions, for example a clockwise direction. Thus, sealed corners 82, 84, 86, 88 are formed by progressively folding along diagonal corner fold lines 38, 40, 42, 44, and then corner piece fold lines 22*a*, 22*b*, 24*a*, 24*b*, 26*a*, 26*b*, 28*a*, 28*b* such that corner flaps 46, 48, 50, 52 overlie exterior surface 71 of each adjacent peripheral tapered walls 74, 76, 78, 80, respectively. In one configuration, the progressive folding forms a liquid-tight corner without requiring secondary adhesives or sealants.

It should be appreciated that portions of the peripheral sections 14, 16, 8, 20 forming corner pieces 22, 24, 26, 28 are notched so that corner flaps 46, 48, 50, 52 do not project above the height of the adjacent wall in one configuration, the corner flaps 46, 48, 50, 52 have the same height as peripheral tapered walls 74, 76, 78, 80 when bent to overlie exterior surface 71. Further, it should be appreciated by one having ordinary skill in the art that other folding sequences may be used to form corner flaps and sealed corners and these modifications are intended to be within the spirit and scope of the invention as claimed.

Figure 7:
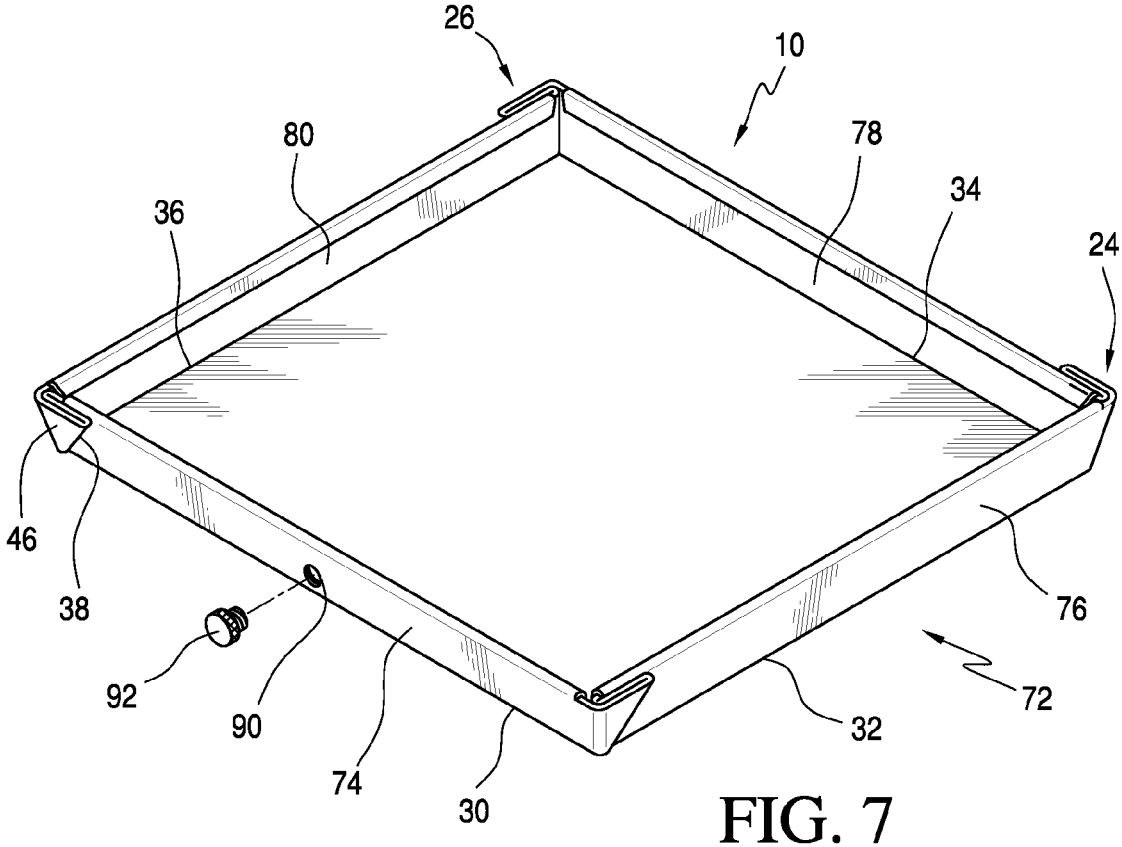
FIG. 7 is a perspective view of the present invention showing a container having an aperture for inserting a drain plug.

FIG. 7 shows peripheral tapered wall 74 having aperture 90 punched through wall 74 to matingly engage drain plug 92. It should be appreciated to one having ordinary skill in the art that aperture 90 can be in any one of the peripheral tapered walls for the insertion of drain plug 92. The drain plug 92 can be tethered to container 72 by a tether 94. The tether 94 extends through the aperture 90 and the drain plug 92 to retain the drain plug relative to the container 72. In one configuration, the tether 94 allows the drain plug 92 to be spaced from the container 72 by a sufficient distance to substantially preclude interfering with the nesting (stacking) of a plurality of containers.

Figure 8:
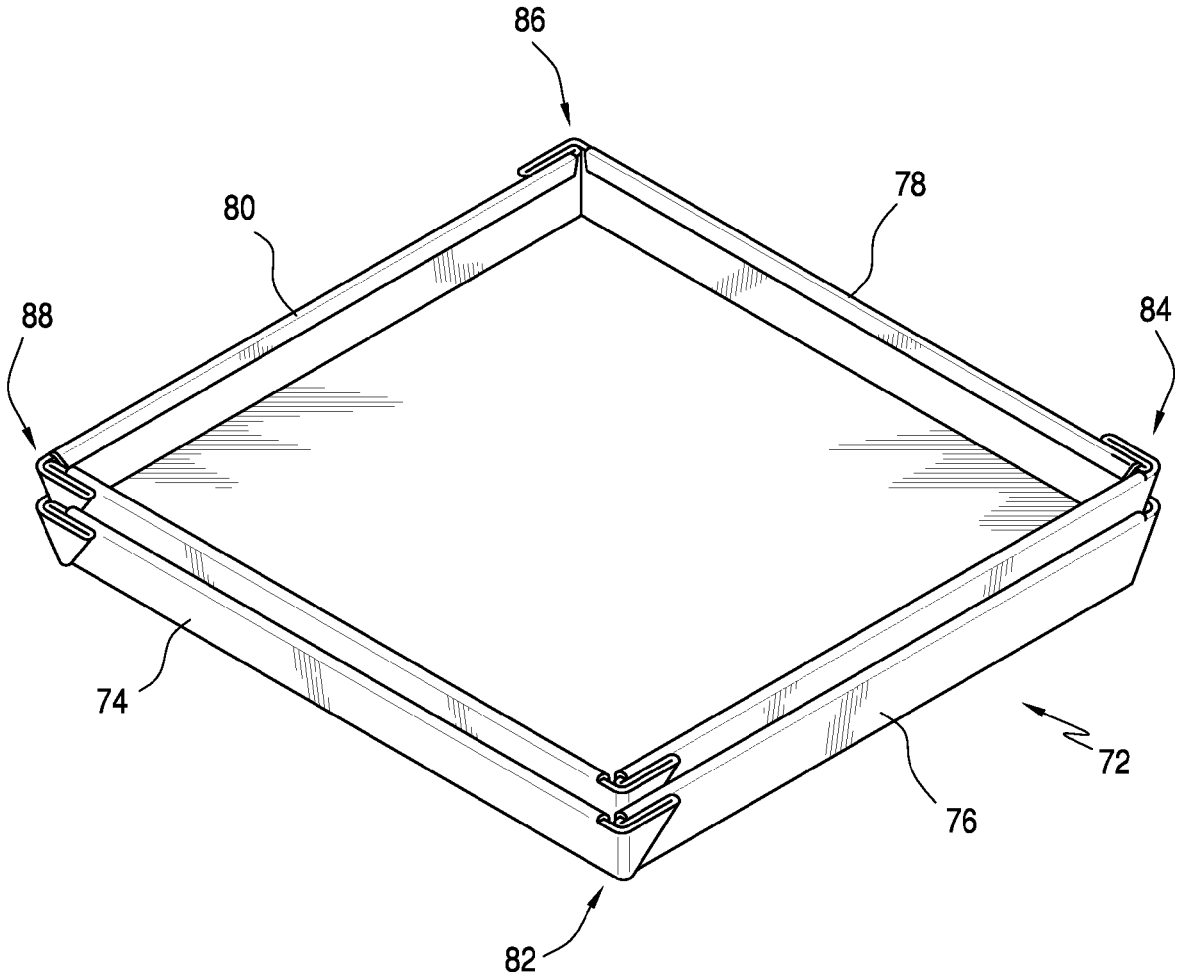
FIG. 8 is a perspective view of the present invention showing a plurality of containers being nested within each other.

FIG. 8 shows a plurality of substantially identical containers 72 each having base 12, four peripheral tapered walls 74, 76, 78, 80 and corresponding corners 82, 84, 86, 88. Containers 72 are shown being stacked such that a substantial portion of peripheral tapered walls of a first nested container 72 is received within a substantial portion of the peripheral tapered walls 74, 76, 78, 80 of a second container 72. The container 72 may be operatively arranged to receive a second container 72, wherein base 12 of a one container 72 is substantially adjacent to base 12 of a nested second container 72.

Thus, at least three containers 721 can be nested to a height that is less than twice the height of a single container. In a further configuration, at least one halt the height of the container 72 is received within a nesting container.

Further, the tethers 94 are sized to dispose the retained drain plug 92 a sufficient distance from the aperture 90 so that a second container can be nested within a first container, so that the nesting is not limited by the respective drain plug 92.

Therefore, as the tether 94 has some thickness, the maximum nesting (stacking) density is achieved when the upper edge (hem) of a lower container 72 is within a thickness of the tether 94 of the top of the aperture 90 of the upper container.

While the invention has been described in connection with a particular embodiment, it is not intended to limit the scope of the invention to the particular form set forth, but on the contrary, it is intended to cover such alternatives, modifications, and equivalents as may be included within the spirit and scope of the invention as defined by the appended claims.

The invention claimed is:

1. A drain pan assembly for receiving liquid from air conditioners, refrigerators, and freezers, the drain pan formed from a blank and comprising:

(a) a planar base, a plurality of peripheral sections, a corresponding plurality of base forming fold lines, and a plurality of corner piece forming fold lines, wherein the plurality of peripheral sections are bent about the corresponding base forming fold lines to define the planar base and to form four peripheral tapered walls having an upper edge and defining an interior surface and an exterior surface of the drain pan assembly, and wherein two of the corner piece forming fold lines and portions of two of the plurality of peripheral sections form a first corner piece;

(b) a diagonal corner fold line within the first corner piece intermediate the two corner piece forming fold lines to form a corner flap, wherein the corner flap is folded along the diagonal corner fold line to form an exposed upper edge and to dispose the two of the corner piece forming fold lines substantially in contact with each other, wherein the corner flap is bent about each of the corner piece forming fold lines to contact the corner flap with the exterior surface of the peripheral tapered wall, and a portion of the corner flap between one corner piece forming fold line and the diagonal corner fold line contacting the exterior surface of the peripheral wall, wherein a remaining portion of the corner flap between the remaining corner piece forming fold line and the diagonal corner fold line is parallel to and contacts the portion of the corner flap contacting the exterior surface of the peripheral tapered wall, and the upper edge of each peripheral tapered wall includes a hem fold line; and (c) a hem bent about the hem fold line of each peripheral tapered wall to define a peripheral wall height, each hem contacting the interior surface of a corresponding peripheral tapered wall, wherein the exposed upper edge of the corner flap is at or below the peripheral wall height, and wherein the plurality of peripheral sections, the planar base, the corner flap and the hem are an integral one piece construction.

2. The drain pan assembly of claim 1, wherein the portions of two of the plurality of peripheral sections forming the first corner piece and the hem have angled edges which together form corner notches in the blank.

3. The drain pan assembly of claim 1, wherein one of the peripheral tapered walls further comprises an aperture and a drain plug, the drain plug matingly engaging the aperture.

4. A first drain pan assembly and a second substantially identical drain pan assembly, each drain pan assembly having a base integral with at least four peripheral tapered walls having integral corners and hems, wherein the base is defined by four base forming fold lines and each of the corners is formed by two peripheral tapered walls and a corresponding corner flap having two corner piece forming fold lines and an intermediate diagonal corner fold line, wherein each corner flap is folded along the diagonal corner fold line to dispose the two corner piece forming fold lines in contact with each other and to form an exposed upper edge of the corner flap, and each corner flap is bent about the two corner piece forming fold lines to dispose each corner flap in contact with the exterior surface of an adjacent portion of a corresponding peripheral tapered wall and to contact a portion of the corner flap between one corner piece forming fold line and the diagonal corner fold line with the exterior surface of the corresponding peripheral wall, wherein a remaining portion of the corner flap between the remaining corner piece forming fold line and the diagonal corner fold line is parallel to and contacts the portion of the corner flap contacting the exterior surface of the corresponding peripheral wall, wherein each of the hems is folded along a hem fold line to contact an interior surface of the peripheral tapered walls and to define a peripheral wall height, the exposed upper edge of the corner flap being at or below the peripheral wall height, and wherein a substantial portion of the peripheral tapered walls of the first drain pan assembly is nested within a substantial portion of the peripheral tapered walls of the second drain pan assembly.

5. The first drain pan assembly and the second substantially identical drain pan assembly of claim 4, wherein the base of the first drain pan assembly is adjacent to the base of the second drain pan assembly.

6. A method of making a drain pan assembly for air conditioners, refrigerators, and freezers, the method comprising the steps of:

(a) cutting a polygonal shaped blank from malleable metal to include notched corner pieces;

(b) folding the blank along base forming fold lines to define a planar base and to form four peripheral tapered walls having an upper edge and to define an interior surface and an exterior surface;

(c) folding along corner piece forming fold lines, wherein two of the corner piece forming fold lines and portions of two of the peripheral tapered walls form a first corner piece;

(d) folding along an intermediate diagonal corner fold line within the first corner piece forming a corner flap, wherein the corner flap is folded along the diagonal corner fold line to form an exposed upper edge and to dispose the two of the corner piece forming fold lines substantially in contact with each other, wherein the corner flap is bent about each of the corner piece forming fold lines to dispose the corner flap along the exterior surface of the peripheral tapered wall and to contact a portion of the corner flap between one corner piece forming fold line and the diagonal corner fold line with the exterior surface of the peripheral wall, wherein a remaining portion of the corner flap between the remaining corner piece forming fold line and the diagonal corner fold line is parallel to and contacting the portion of the corner flap contacting the exterior surface of the peripheral tapered wall, and wherein the upper edge of each peripheral wall has a hem fold line; and (e) folding a hem about the hem fold line of each peripheral wall to define a peripheral wall height and to contact the hem with the interior surface of the peripheral tapered wall, wherein the exposed upper edge of the corner flap is at or below the peripheral wall height, and wherein the peripheral sections, the corner flap and the hem are integral.

7. The method of claim 6, further comprising the step of forming an aperture in one of the peripheral tapered walls for the insertion of a drain plug.

8. A drain pan assembly for receiving liquid from air conditioners, refrigerators, and freezers, the drain pan formed from a blank and comprising:

(a) a planar base;

(b) four peripheral walls extending upwardly from the base at an obtuse angle defining an interior surface and an exterior surface, each peripheral wall having a hem integral to the peripheral wall, the hem being bent about a hem fold line to form an upper edge of the peripheral wall defined by the hem fold line, a portion of the hem contacting the interior surface; and (c) four corner flaps, each corner flap defined by two corner piece forming fold lines and an intermediate diagonal corner fold line, wherein the corner flaps are folded along the diagonal corner fold line to form an exposed upper edge and to dispose the two corner piece forming fold lines substantially in contact with each other, wherein the corner flap is bent about each of the corner piece forming fold lines to dispose the corner flap along the exterior surface of the peripheral tapered wall and to contact a portion of the corner flap between one corner piece forming fold line and the diagonal corner fold line with the exterior surface of the peripheral wall, wherein a remaining portion of the corner flap between the remaining corner piece forming fold line and the diagonal corner fold line is parallel to and contacts the portion of the corner flap contacting the exterior surface of the peripheral tapered wall, and wherein the exposed upper edge of the corner flap is at or below the upper edge of the peripheral wall.

9. The drain pan assembly of claim 8, wherein the at least four peripheral tapered walls each comprises a hem, each of the hems folded along a hem fold line, wherein each of the hems comprises at least two layers of material and contacts an interior surface of the peripheral tapered walls.

10. The drain pan assembly of claim 9, wherein each hem further comprises an angled edge at each terminal end.

11. The drain pan assembly of claim 8, wherein each corner flap comprises an angled edge and three fold lines, the three fold lines are progressively folded to form each corner.

12. The drain pan assembly of claim 8, wherein at least one of the peripheral tapered walls comprises an aperture and a drain plug, the drain plug matingly engaging the aperture.

* * * * *